US011120715B2

(12) United States Patent
Kwon et al.

(10) Patent No.: US 11,120,715 B2
(45) Date of Patent: Sep. 14, 2021

(54) METHOD OF OBTAINING OVERDRIVING DATA OF A DISPLAY DEVICE CAPABLE OF PROVIDING A SUBSTANTIALLY UNIFORM CHARGING RATE, METHOD OF OPERATING A DISPLAY DEVICE, AND DISPLAY DEVICE

(71) Applicant: Samsung Display Co., Ltd., Yongin-si (KR)

(72) Inventors: Sangan Kwon, Cheonan-si (KR); Kyunho Kim, Hwaseong-si (KR); Sungjin Kim, Gwangju (KR); Subin Park, Hwaseong-si (KR); Yeseul Lee, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/853,391

(22) Filed: Apr. 20, 2020

(65) Prior Publication Data

US 2021/0027679 A1 Jan. 28, 2021

(30) Foreign Application Priority Data

Jul. 23, 2019 (KR) ..... 10-2019-0089051

(51) Int. Cl.
*G09G 3/00* (2006.01)
*G09G 3/20* (2006.01)

(52) U.S. Cl.
CPC ..... *G09G 3/006* (2013.01); *G09G 3/2003* (2013.01); *G09G 2320/0223* (2013.01); *G09G 2360/145* (2013.01)

(58) Field of Classification Search
CPC ..... G09G 3/006; G09G 3/2003
See application file for complete search history.

(56) References Cited

U.S. PATENT DOCUMENTS

2002/0018035 A1* 2/2002 Song ..... G09G 3/3655 345/87
2006/0284896 A1* 12/2006 Shen ..... G09G 3/2007 345/690

(Continued)

FOREIGN PATENT DOCUMENTS

KR 10-1094303 B1 12/2011
KR 10-1814222 B1 1/2018

*Primary Examiner* — Chun-Nan Lin
(74) *Attorney, Agent, or Firm* — Lewis Roca Rothgerber Christie LLP

(57) ABSTRACT

A method of obtaining overdriving data includes providing a first data voltage corresponding to a current line reference gray level to a second pixel for first and second data writing times for first and second pixels in a first frame, measuring first luminance based on the first data voltage, applying a second data voltage corresponding to a previous line reference gray level for the first data writing time in a second frame, providing a third data voltage of an overdriving voltage corresponding to a predicted overdriving gray level added to the first data voltage for the second data writing time in the second frame, measuring second luminance based on the third data voltage, and determining an overdriving value corresponding to a reference gray level pair of the current and the previous line reference gray level as the predicted overdriving gray level when the first and second luminance are the same.

20 Claims, 11 Drawing Sheets

(56) References Cited

U.S. PATENT DOCUMENTS

| | | | | |
|---|---|---|---|---|
| 2007/0216623 | A1* | 9/2007 | Kimura | G09G 3/2011 345/89 |
| 2008/0158137 | A1* | 7/2008 | Yoshida | G09G 3/3648 345/102 |
| 2008/0284720 | A1* | 11/2008 | Fukutome | G09G 3/3406 345/102 |
| 2011/0234625 | A1* | 9/2011 | Irie | G09G 3/3648 345/601 |
| 2014/0285537 | A1* | 9/2014 | Kimura | G09G 3/3291 345/690 |

* cited by examiner

FIG. 4

| CLRG \ PLRG | 0 | 2 | 4 | 8 | 16 | 32 | 64 | 128 | 255 |
|---|---|---|---|---|---|---|---|---|---|
| 0 | X | ODV | ODV | ODV | ODV | ODV | ODV | ODV | ODV |
| 2 | ODV | X | ODV | ODV | ODV | ODV | ODV | ODV | ODV |
| 4 | ODV | ODV | X | ODV | ODV | ODV | ODV | ODV | ODV |
| 8 | ODV | ODV | ODV | X | ODV | ODV | ODV | ODV | ODV |
| 16 | ODV | ODV | ODV | ODV | X | ODV | ODV | ODV | ODV |
| 32 | ODV | ODV | ODV | ODV | ODV | X | ODV | ODV | ODV |
| 64 | ODV | ODV | ODV | ODV | ODV | ODV | X | ODV | ODV |
| 128 | ODV | ODV | ODV | ODV | ODV | ODV | ODV | X | ODV |
| 255 | ODV | ODV | ODV | ODV | ODV | ODV | ODV | ODV | X |

METHOD OF OBTAINING OVERDRIVING DATA OF A DISPLAY DEVICE CAPABLE OF PROVIDING A SUBSTANTIALLY UNIFORM CHARGING RATE, METHOD OF OPERATING A DISPLAY DEVICE, AND DISPLAY DEVICE

CROSS-REFERENCE TO RELATED APPLICATION

This application claims priority to, and the benefit of, Korean Patent Applications No. 10-2019-0089051, filed on Jul. 23, 2019 in the Korean Intellectual Property Office (KIPO), the contents of which are incorporated herein in their entirety by reference.

BACKGROUND

1. Field

Embodiments of the present disclosure relate generally to methods of obtaining overdriving data of display devices, methods of operating the display devices, and the display devices themselves.

2. Description of the Related Art

A display device provides a data voltage to a pixel to display an image corresponding to the data voltage. The data voltage may be delayed by a resistor-capacitor (RC) delay depending on a distance from a data driver to the pixel. In other words, a transition time of the data voltage for a pixel that is relatively far from the data driver may be longer than a transition time of the data voltage for a pixel that is relatively close to the data driver. Accordingly, as the distance of the pixel from the data driver increases, the transition time of the data voltage increases, and thus a charging rate of the pixel decreases, which results in deterioration of an image quality. For example, as a resolution of the display device increases, the length of one horizontal time (1H) decreases, and thus the deterioration of image quality may escalate.

SUMMARY

Some embodiments provide a method of obtaining overdriving data of a display device capable of providing a substantially uniform charging rate.

Some embodiments provide a method of operating a display device capable of providing a substantially uniform charging rate.

Some embodiments provide a display device that uses overdriving data capable of providing a substantially uniform charging rate.

According to some embodiments, there is provided a method of obtaining overdriving data of a display device including first, second, and third pixels respectively connected to first, second, and third gate lines and connected to a same data line, the method including providing a first data voltage corresponding to a current line reference gray level to the second pixel for a first data writing time for the first pixel and for a second data writing time for the second pixel in a first frame, measuring first luminance of an image displayed based on the first data voltage, applying a second data voltage corresponding to a previous line reference gray level to the data line for the first data writing time in a second frame, providing a third data voltage, which includes an overdriving voltage corresponding to a predicted overdriving gray level added to the first data voltage, to the second pixel for the second data writing time in the second frame, measuring second luminance of an image displayed based on the third data voltage, and determining an overdriving value corresponding to a reference gray level pair of the current line reference gray level and the previous line reference gray level as the predicted overdriving gray level when the second luminance is substantially a same as the first luminance.

Providing the first data voltage to the second pixel in the first frame may include shifting a first gate signal in the first frame such that the first gate signal is not applied to the first gate line for the first data writing time in the first frame, applying a second gate signal to the second gate line for the first data writing time and the second data writing time in the first frame, and applying the first data voltage to the data line for the first data writing time and the second data writing time in the first frame.

The method may further include generating the first gate signal in synchronization with a first gate clock signal input to a gate driver, wherein shifting the first gate signal includes shifting the first gate clock signal input to the gate driver.

The method may further include advancing the first gate clock signal by one horizontal time while a source emphasis test enable signal has an active level.

The method may further include providing the second data voltage to the third pixel for a third data writing time for the third pixel in the first frame.

The method may further include shifting a first gate signal in the second frame such that the first gate signal is not applied to the first gate line for the first data writing time in the second frame.

The method may further include changing the predicted overdriving gray level when the second luminance is different from the first luminance.

The method may further include providing the second data voltage to the third pixel for a third data writing time for the third pixel in the second frame.

The method may further include displaying different respective colors by the first, second, and third pixels.

The first pixel may include a blue pixel, the second pixel may include a green pixel, and the third pixel may include a red pixel.

The method may further include determining the overdriving value at each of N*M reference gray level pairs of N current line reference gray levels and M previous line reference gray levels, N being an integer greater than 0, and M being an integer greater than 0, and storing the overdriving data representing the overdriving values determined at the N*M reference gray level pairs in an overdriving data memory of the display device.

The method may further include obtaining the overdriving data at each of a plurality of sampling positions of a display panel of the display device, and storing the overdriving data obtained at the plurality of sampling positions in the overdriving data memory.

According to some embodiments, there is provided a method of operating a display device including first, second, and third pixels respectively connected to first, second, and third gate lines and connected to a same data line, the method including providing a first data voltage corresponding to a current line reference gray level to the second pixel for a first data writing time for the first pixel and a second data writing time for the second pixel in a first frame, measuring first luminance of an image displayed based on the first data voltage, applying a second data voltage corresponding to a previous line reference gray level to the data line for the first data writing time in a second frame, providing a third data voltage, which includes an overdriving voltage corresponding to a predicted overdriving gray level added to the first data voltage, to the second pixel for the second data writing time in the second frame, measuring second luminance of an image displayed based on the third data voltage, determining an overdriving value corresponding to a reference gray level pair of the current line reference gray level and the previous line reference gray level as the predicted overdriving gray level when the second luminance is substantially a same as the first luminance, storing overdriving data representing the determined overdriving value in an overdriving data memory of the display device, receiving input image data, generating output image data by compensating the input image data based on the overdriving data, and displaying an image based on the output image data.

The method may further include determining the overdriving value at each of N*M reference gray level pairs of N current line reference gray levels and M previous line reference gray levels, where N is an integer greater than 0, and M is an integer greater than 0, wherein the overdriving data stored in the overdriving data memory represent the overdriving values determined at the N*M reference gray level pairs.

When the input image data represent a first gray level with respect to the first pixel, and represent a second gray level with respect to the second pixel, the method may further include calculating the overdriving value for the second pixel by performing a bilinear interpolation on the overdriving values at the reference gray level pairs of two previous line reference gray levels adjacent to the first gray level among the M previous line reference gray levels and two current line reference gray levels adjacent to the second gray level among the N current line reference gray levels, and generating the output image data for the second pixel by adding the overdriving value for the second pixel to the second gray level.

The method may further include obtaining the overdriving data at each of a plurality of sampling positions of a display panel of the display device, and storing the overdriving data obtained at the plurality of sampling positions in the overdriving data memory.

The method may further include calculating the overdriving value for each pixel by performing a bilinear interpolation on the overdriving values at four sampling positions adjacent to each pixel among the plurality of sampling positions, and generating the output image data for the each pixel by adding the calculated overdriving value for the each pixel to a gray level represented by the input image data for the each pixel.

According to some embodiments, there is provided a display device including a display panel including a plurality of pixels, a gate driver configured to provide gate signals to the plurality of pixels, a data driver configured to provide data signals to the plurality of pixels, an overdriving data memory configured to store overdriving data representing an overdriving value for at least one pixel among the plurality of pixels, and a controller configured to control the gate driver and the data driver, wherein the data driver is configured to provide a first data voltage corresponding to a current line reference gray level to the at least one pixel for at least two horizontal times in a first frame, wherein first luminance of an image displayed based on the first data voltage is measured, apply a second data voltage corresponding to a previous line reference gray level to a data line connected to the at least one pixel in a second frame, and provide a third data voltage, which includes an overdriving voltage corresponding to a predicted overdriving gray level added to the first data voltage, to the at least one pixel for one horizontal time in the second frame, wherein second luminance of an image displayed based on the third data voltage is measured, and wherein the overdriving value for the at least one pixel is determined as the predicted overdriving gray level when the second luminance is substantially a same as the first luminance.

The controller may include a gate clock shifter configured to shift at least one of a plurality of gate clock signals input to the gate driver in response to a source emphasis test enable signal.

The controller may include a data compensator configured to receive input image data, to generate output image data by compensating the input image data based on the overdriving data stored in the overdriving data memory, and to provide the output image data to the data driver.

As described above, in a method of obtaining overdriving data of a display device, a method of operating the display device, and the display device according to various embodiments, first luminance may be measured by providing a data voltage corresponding to a current line reference gray level to at least one pixel for at least two horizontal times in a first frame, second luminance may be measured by providing a voltage where an overdriving voltage corresponding to a predicted overdriving gray level is added to the data voltage to the at least one pixel for one horizontal time in a second frame, and an overdriving value for the at least one pixel may be determined based on the first luminance and the second luminance. Accordingly, optimal overdriving data for the display device may be obtained.

BRIEF DESCRIPTION OF THE DRAWINGS

Illustrative, non-limiting embodiments will be more clearly understood from the following detailed description taken in conjunction with the accompanying drawings.

FIG. 4 is a diagram for describing an example of overdriving data stored in an overdriving data memory included in a display device of FIG. 1.

DETAILED DESCRIPTION

Figure 1:
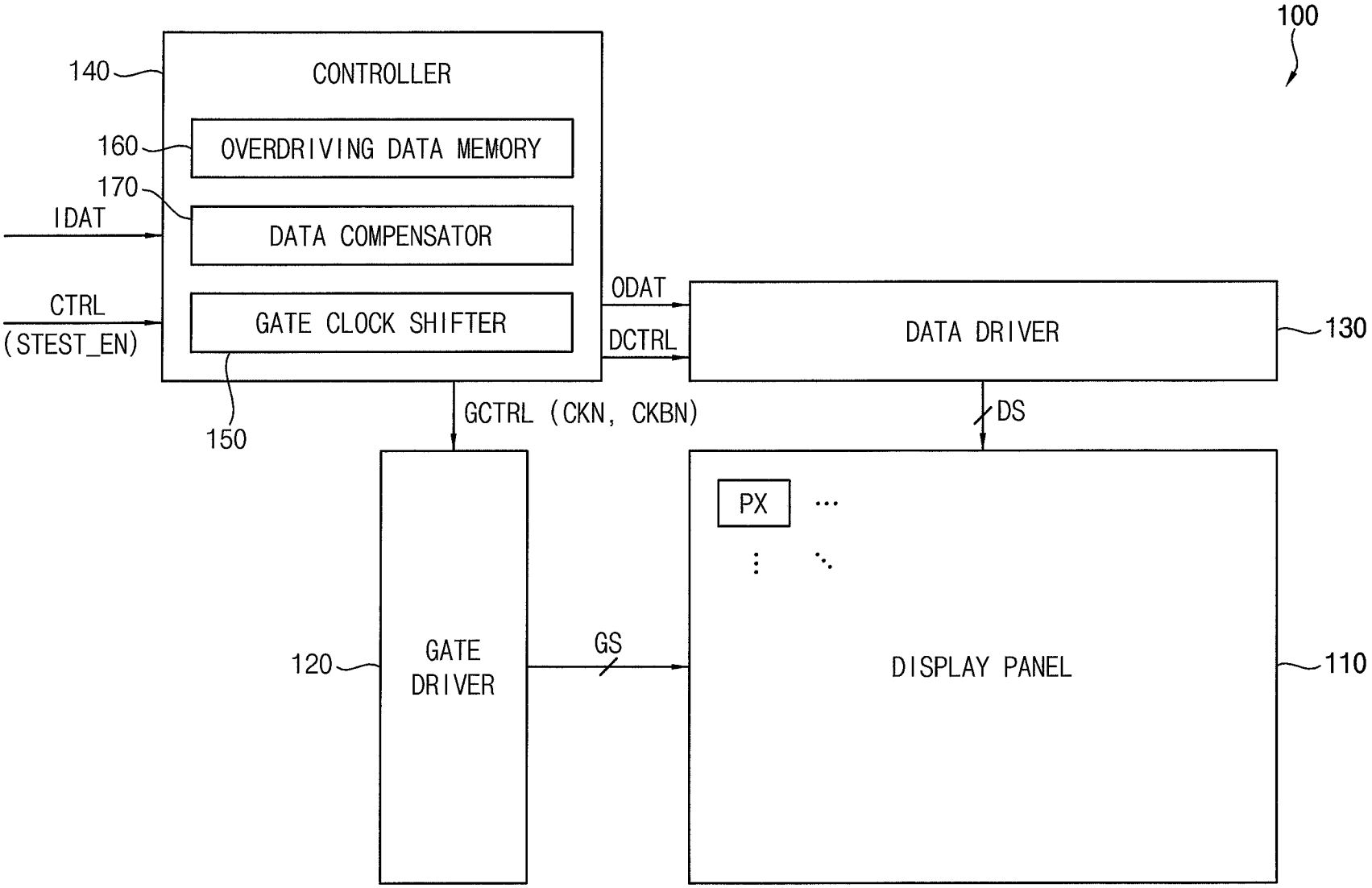
FIG. 1 is a block diagram illustrating a display device according to some embodiments of the present disclosure.

Features of the inventive concept and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described.

Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

For the purposes of this disclosure, expressions such as "at least one of," when preceding a list of elements, modify the entire list of elements and do not modify the individual elements of the list. For example, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure."

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to some embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate.

Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
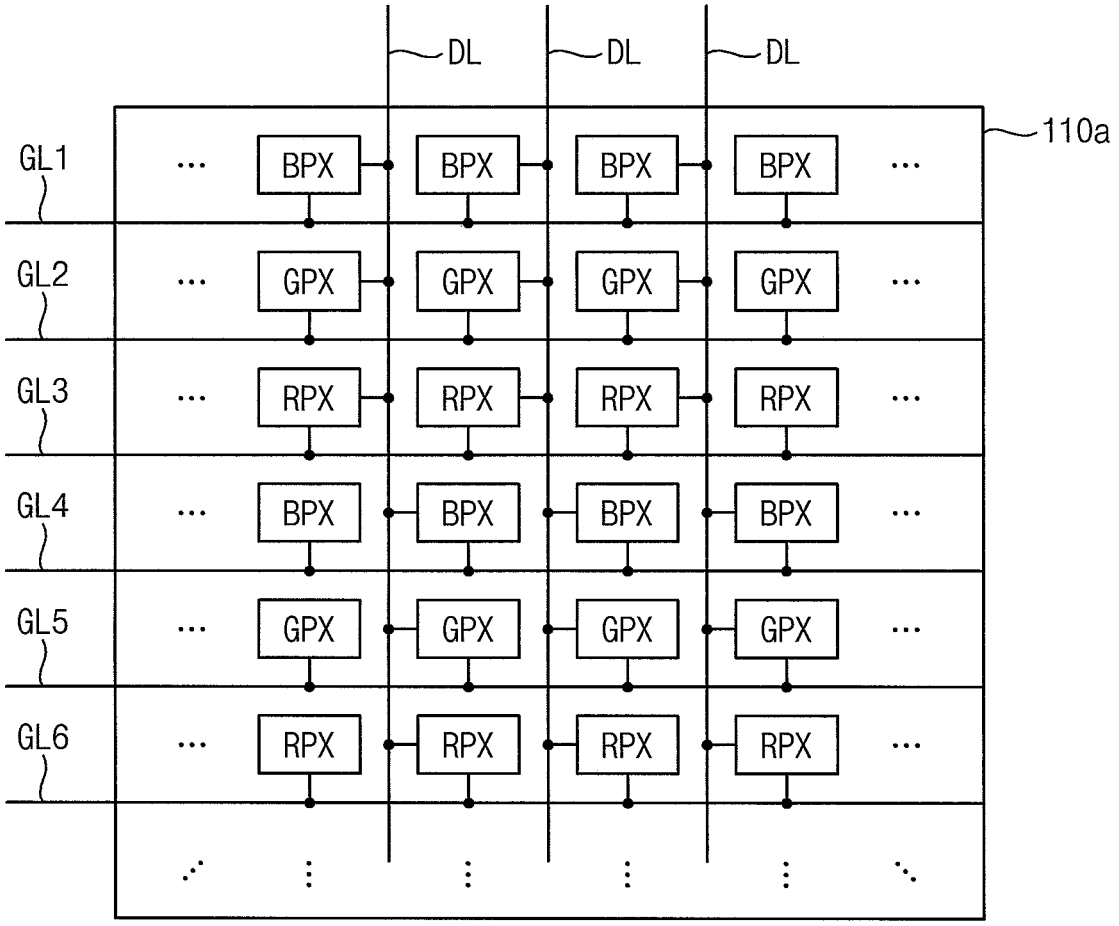
FIG. 2 is a block diagram illustrating an example of a display panel included in a display device of FIG. 1.
Figure 3:
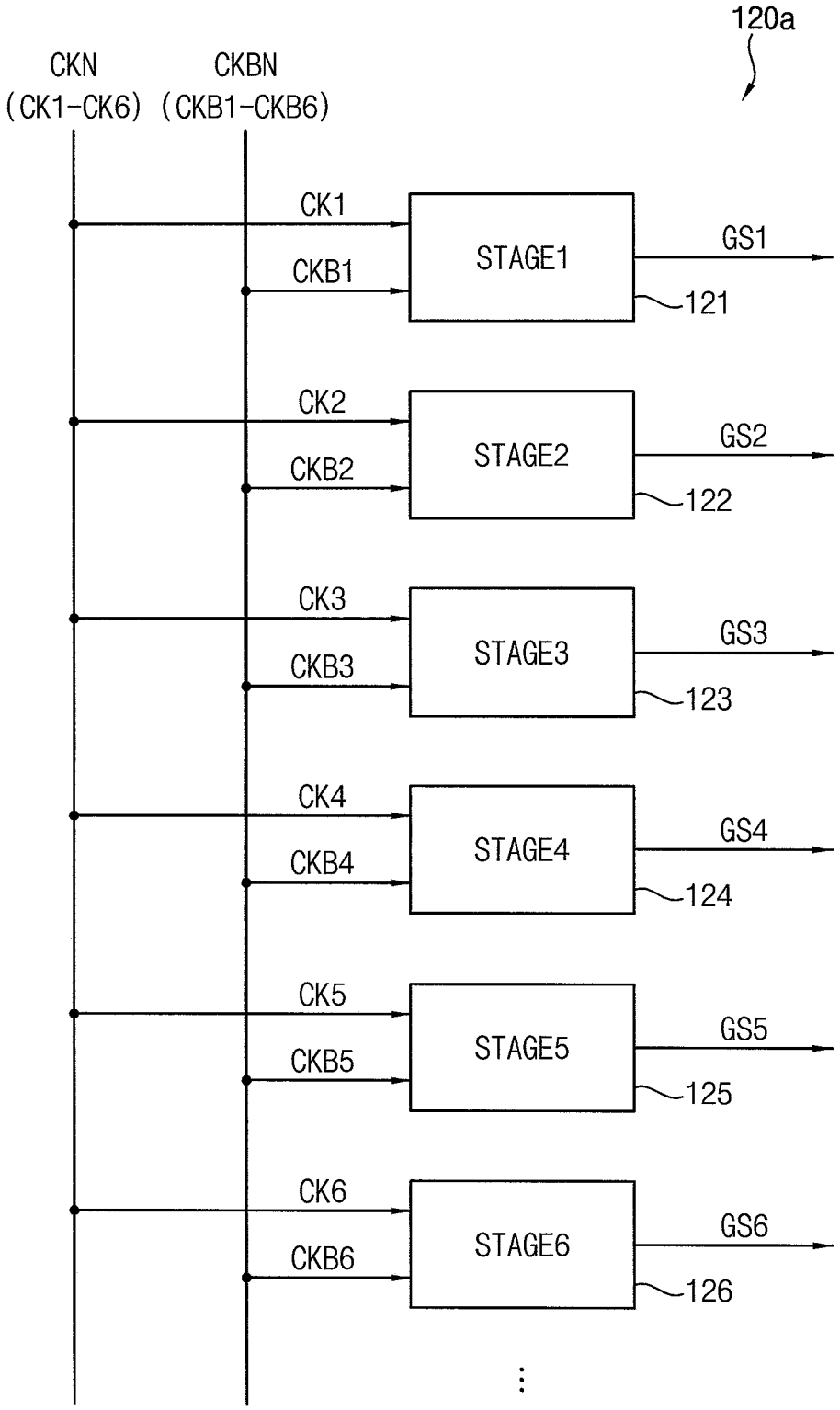
FIG. 3 is a block diagram illustrating an example of a gate driver included in a display device of FIG. 1.
Figure 5:
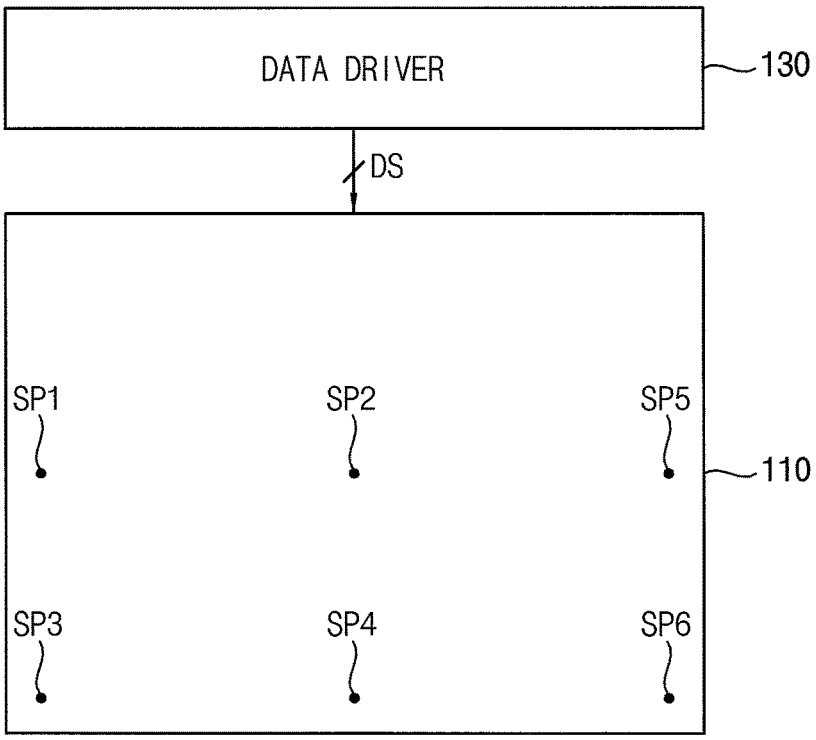
FIG. 5 is a diagram for describing an example of a plurality of sampling positions where overdriving data are obtained.
Figure 6:
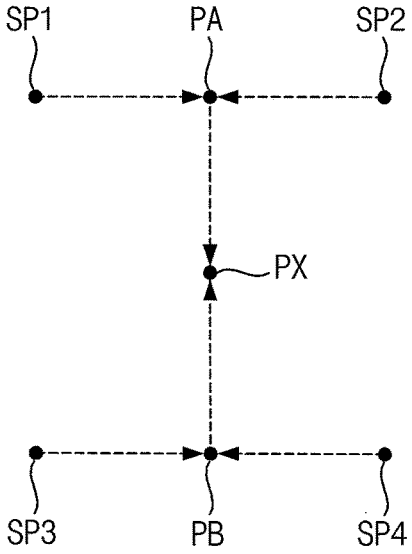
FIG. 6 is a diagram for describing an example of a bilinear interpolation performed by a data compensator included in a display device of FIG. 1.

FIG. 1 is a block diagram illustrating a display device according to some embodiments of the present disclosure, FIG. 2 is a block diagram illustrating an example of a display panel included in a display device of FIG. 1, FIG. 3 is a block diagram illustrating an example of a gate driver included in a display device of FIG. 1, FIG. 4 is a diagram for describing an example of overdriving data stored in an overdriving data memory included in a display device of FIG. 1, FIG. 5 is a diagram for describing an example of a plurality of sampling positions where overdriving data are obtained, and FIG. 6 is a diagram for describing an example of a bilinear interpolation performed by a data compensator included in a display device of FIG. 1.

Referring to FIG. 1, a display device 100 may include a display panel 110 that includes a plurality of pixels PX, a gate driver 120 that provides gate signals GS to the plurality of pixels PX, a data driver 130 that provides data signals DS to the plurality of pixels PX, a controller 140 that controls the gate driver 120 and the data driver 130, and an overdriving data memory 160 that stores overdriving data.

The display panel 110 may include a plurality of gate lines, a plurality of data lines, and the plurality of pixels PX connected to the plurality of gate lines and the plurality of data lines. In some embodiments, each pixel PX may include a switching transistor, and a liquid crystal capacitor connected to the switching transistor, and the display panel 110 may be a liquid crystal display (LCD) panel. In other embodiments, each pixel PX may include at least two transistors, at least one capacitor, and an organic light emitting diode (OLED), and the display panel 110 may be an OLED display panel. However, the display panel 110 is not limited to the LCD panel and the OLED panel, and may be any display panel in other embodiments.

In some embodiments, as illustrated in FIG. 2, each data line DL of the display panel 110*a* may be connected to pixels BPX, GPX, and RPX displaying two or more different colors. In the display panel 110*a* of FIG. 2, first, second, and third pixels BPX, GPX, and RPX connected to the same data line DL and respectively connected to first, second, and third gate lines GL1, GL2, and GL3 may display different colors. For example, pixels connected to a first gate line GL1 in a first row line may be blue pixels BPX, pixels connected to a second gate line GL2 in a second row line may be green pixels GPX, pixels connected to a third gate line GL3 in a third row line may be red pixels RPX, pixels connected to a fourth gate line GL4 in a fourth row line may be blue pixels BPX, pixels connected to a fifth gate line GL5 in a fifth row line may be green pixels GPX, and pixels connected to a sixth gate line GL6 in a sixth row line may be red pixels RPX.

Further, as illustrated in FIG. 2, each data line DL may be alternately connected to left pixels PX or right pixels PX (or in a zigzag form) in groups of three pixels (e.g., each data line may be connected to pixels on the left side thereof and to pixels on the right side thereof), but the connection between the data line DL and the pixels PX is not limited to the example shown in FIG. 2. Further, although FIG. 2 illustrates an example where the pixels BPX, GPX, and RPX displaying different colors are connected to each data line DL, the arrangement of the pixels BPX, GPX, and RPX are not limited to the example of FIG. 2. For example, the plurality of pixels PX may be arranged such that pixels PX that display the same color may be connected to the same data line DL.

The gate driver 120 may generate the gate signals GS based on a gate control signal GCTRL provided from the controller 140, and may sequentially apply the gate signals GS to the plurality of gate lines. In some embodiments, the gate control signal GCTRL may include, but is not limited to, a gate clock signal CKN, an inverted gate clock signal CKBN, and a scan start pulse, etc. According to some embodiments, the gate driver 120 may be mounted directly on the display panel 110, may be connected to the display panel 110 in a form of a tape carrier package (TCP) or a chip on film (COF), and may be integrated in a peripheral portion of the display panel 110.

In some embodiments, the gate clock signal CKN and the inverted gate clock signal CKBN provided from the controller 140 to the gate driver 120 may include a plurality of gate clock signals and a plurality of inverted gate clock signals having different phases. For example, as illustrated in FIG. 3, the gate driver 120*a* may include a plurality of stages 121, 122, 123, 124, 125, and 126 that apply a plurality of gate signals GS1, GS2, GS3, GS4, GS5 and GS6 to a plurality of gate lines, respectively. The gate driver 120*a* may receive first through sixth gate clock signals CK1, CK2, CK3, CK4, CK5 and CK6 having different phases or being sequentially delayed by one horizontal time (1H) from the controller 140, and may further receive first through sixth inverted gate clock signals CKB1, CKB2, CKB3, CKB4, CKB5, and CKB6 that are inversion signals of the first through sixth gate clock signals CK1, CK2, CK3, CK4, CK5, and CK6 from the controller 140. The gate driver 120*a* may generate the plurality of gate signals GS1, GS2, GS3, GS4, GS5, and GS6 in synchronization with the first through sixth gate clock signals CK1, CK2, CK3, CK4, CK5, and CK6 and the first through sixth inverted gate clock signals CKB1, CKB2, CKB3, CKB4, CKB5, and CKB6 that are sequentially delayed.

For example, a first stage 121 may receive the first gate clock signal CK1 and the first inverted gate clock signal CKB1, and may generate a first gate signal GS1 in synchronization with the first gate clock signal CK1. A second stage 122 may receive the second gate clock signal CK2 and the second inverted gate clock signal CKB2, and may generate a second gate signal GS2 in synchronization with the second gate clock signal CK2. A third stage 123 may receive the third gate clock signal CK3 and the third inverted gate clock signal CKB3, and may generate a third gate signal GS3 in synchronization with the third gate clock signal CK3. A fourth stage 124 may receive the fourth gate clock signal CK4 and the fourth inverted gate clock signal CKB4, and may generate a fourth gate signal GS4 in synchronization with the fourth gate clock signal CK4. A fifth stage 125 may receive the fifth gate clock signal CK5 and the fifth inverted gate clock signal CKB5, and may generate a fifth gate signal GS5 in synchronization with the fifth gate clock signal CK5. A sixth stage 126 may receive the sixth gate clock signal CK6 and the sixth inverted gate clock signal CKB6, and may generate a sixth gate signal GS6 in synchronization with the sixth gate clock signal CK6. Further, subsequent seventh through twelfth stages may generate seventh through twelfth gate signals in synchronization with the first through sixth inverted gate clock signals CKB1, CKB2, CKB3, CKB4, CKB5, and CKB6, respectively, and subsequent thirteenth through eighteenth stages may generate thirteenth through eighteenth gate signals in synchronization with the first through sixth gate clock signals CK1, CK2, CK3, CK4, CK5, and CK6, respectively. The first through sixth gate clock signals CK1, CK2, CK3, CK4, CK5, and CK6 and the first through sixth inverted gate clock signals CKB1, CKB2, CKB3, CKB4, CKB5, and CKB6 may be sequentially delayed by one horizontal time, and thus the plurality of gate signals GS1, GS2, GS3, GS4, GS5, and GS6 generated in synchronization with the first through sixth gate clock signals CK1, CK2, CK3, CK4, CK5, and CK6 and the first through sixth inverted gate clock signals CKB1, CKB2, CKB3, CKB4, CKB5, and CKB6 may be sequentially delayed by one horizontal time.

The data driver 130 may generate the data signals DS based on output image data ODAT and a data control signal DCTRL provided from the controller 140, and may apply the data signals DS to the plurality of data lines. In some embodiments, the data control signal DCTRL may include, but is not limited to, a horizontal start signal, a load signal, etc. According to some embodiments, the data driver 130 may be mounted directly on the display panel 110, may be connected to the display panel 110 in the form of a TCP connection or a COF connection, and may be integrated in the peripheral portion of the display panel 110.

The controller (e.g., a timing controller (TCON)) 140 may receive input image data IDAT and a control signal CTRL from an external host (e.g., a graphic processing unit (GPU) or a graphic card). In some embodiments, the input image data IDAT may be RGB data including red image data, green image data, and blue image data. In some embodiments, the control signal CTRL may include a source emphasis test enable signal STEST_EN informing that an operation for obtaining overdriving data is to be performed. Further, in some embodiments, the control signal CTRL may further include, but is not limited to, a data enable signal, a master clock signal, etc. The controller 140 may generate the gate control signal GCTRL, the data control signal DCTRL, and the output image data ODAT based on the control signal CTRL and the input image data IDAT. The controller 140 may control an operation of the gate driver 120 by providing the gate control signal GCTRL to the gate driver 120, and may control an operation of the data driver 130 by providing the data control signal DCTRL and the output image data ODAT to the data driver 130.

The data signal DS output from the data driver 130 may be delayed according to distances of the plurality of pixels PX from the data driver 130. For example, each data line and the plurality of pixels PX connected to the data line may be represented as an equivalent model including resistors connected in series and capacitors connected to the resistors, and the data signal DS may be delayed by a resistor-capacitor (RC) delay of the resistors and the capacitors according to the respective distances of the plurality of pixels PX (e.g., from the data driver 130). Thus, a pixel PX located far from the data driver 130 may not receive and store the data signal DS having a desired voltage level, and thus an image quality of the display device 100 may be deteriorated. Further, with respect to a first pixel PX in a previous row line and a second pixel PX in a current row line, which are connected to the same data line, in a case where the input image data IDAT for the first pixel PX and the input image data IDAT for the second pixel PX have a relatively large gray level difference, the data signal DS having the desired voltage level may not be provided or stored in the second pixel PX.

However, in the display device 100 according to some embodiments of the present disclosure, to provide and store the data signal DS having the desired voltage level in each pixel PX, the overdriving data may be used. The overdriving data memory 160 may store the overdriving data representing an overdriving value for at least one pixel PX among the plurality of pixels PX of the display panel 110. According to some embodiments, the overdriving data memory 160 may be located inside or outside the controller 140.

In some embodiments, with respect to the at least one pixel PX, the overdriving data stored in the overdriving data memory 160 may represent at least one overdriving value determined at one or more reference gray level pairs. For example, the overdriving value may be determined at each of N*M reference gray level pairs of N current line reference gray levels and M previous line reference gray levels, where N is an integer that is greater than 0, and M is an integer that is greater than 0. The overdriving data stored in the overdriving data memory 160 may represent the overdriving values determined at the N*M reference gray level pairs.

For example, as illustrated in FIG. 4, the overdriving values ODV may be determined at reference gray level pairs of nine current line reference gray levels CLRG (e.g., 0-gray level, 2-gray level, 4-gray level, 8-gray level, 16-gray level, 32-gray level, 64-gray level, 128-gray level, and 255-gray level) and nine previous line reference gray levels PLRG (e.g., 0-gray level, 2-gray level, 4-gray level, 8-gray level, 16-gray level, 32-gray level, 64-gray level, 128-gray level, and 255-gray level), respectively. In some embodiments, at a reference gray level pair where the current line reference gray level CLRG and the previous line reference gray level PLRG are substantially the same, the overdriving value ODV may not be required. In this case, with respect to each pixel PX, the overdriving data may represent seventy-two different overdriving values ODV at seventy-two reference gray level pairs.

According to some embodiments, in the overdriving data memory 160, the overdriving data for all of the pixels PX of the display panel 110 may be stored, or the overdriving data for a portion of the pixels PX may be stored. In some embodiments, the overdriving data may be obtained with respect to the pixels PX located at a plurality of sampling positions of the display panel 110, and the overdriving data for the pixels PX located at the plurality of sampling positions may be stored in the overdriving data memory 160.

For example, as illustrated in FIG. 5, the overdriving data may be obtained with respect to the pixels PX located at six sampling positions SP1, SP2, SP3, SP4, SP5, and SP6, and the overdriving data for the pixels PX located at the six sampling positions SP1, SP2, SP3, SP4, SP5, and SP6 may be stored in the overdriving data memory 160. In some embodiments, as illustrated in FIG. 5, the RC delay may barely occur at positions close to the data driver 130, and thus the overdriving data might not be obtained at the positions close to the data driver 130. In an example, first and fifth sampling positions SP1 and SP5 may be symmetric to each other, and thus the overdriving data obtained at only one of the first and fifth sampling positions SP1 and SP5 may be stored in the overdriving data memory 160. Further, third and sixth sampling positions SP3 and SP6 may be symmetric to each other, and thus the overdriving data obtained at only one of the third and sixth sampling positions SP3 and SP6 may be stored in the overdriving data memory 160.

The controller 140 may include a data compensator 170 that receives the input image data IDAT, generates the output image data ODAT by compensating the input image data IDAT based on the overdriving data stored in the overdriving data memory 160, and provides the output image data ODAT to the data driver 130. For example, with respect to each pixel PX, the data compensator 170 may generate the output image data ODAT for the pixel PX by adding the overdriving value represented by the overdriving data to a gray level represented by the input image data IDAT for the pixel PX. For example, the overdriving data representing the overdriving values corresponding to the plurality of reference gray level pairs with respect to each of the pixels PX at the plurality of sampling points may be stored in the overdriving data memory 160, and the data compensator 170 may calculate the overdriving value for each pixel PX by performing an interpolation between gray levels and/or an interpolation between positions on the overdriving data.

For example, in a case where the overdriving values, which are determined at the N*M reference gray level pairs of the N current line reference gray levels and the M previous line reference gray levels, are stored in the overdriving data memory 160, and where a first pixel PX and a second pixel PX are sequentially connected to the same data line, the input image data IDAT for the first pixel PX represent a first gray level, and the input image data IDAT for the second pixel PX represent a second gray level, the data compensator 170 may calculate the overdriving value for the second pixel PX by performing a bilinear interpolation on the overdriving values at the reference gray level pairs of two previous line reference gray levels that are adjacent to the first gray level among the M previous line reference gray levels and two current line reference gray levels adjacent to the second gray level among the N current line reference gray levels. Further, the data compensator 170 may generate the output image data ODAT for the second pixel PX by adding the overdriving value for the second pixel PX to the second gray level. This interpolation between gray levels may be performed before or after the interpolation between positions described below.

Further, the data compensator 170 may calculate the overdriving value for each pixel PX by performing a bilinear interpolation on the overdriving values at four sampling positions adjacent to the pixel PX. For example, as illustrated in FIG. 6, the data compensator 170 may calculate an overdriving value at a first intermediate position PA by performing a linear interpolation on the overdriving values at first and second sampling positions SP1 and SP2, may calculate an overdriving value at a second intermediate position PB by performing a linear interpolation on the overdriving values at third and fourth sampling positions SP3 and SP4, and may calculate the overdriving value for the pixel PX by performing a linear interpolation on the overdriving values at the first and second intermediate positions PA and PB. Further, the data compensator 170 may generate the output image data ODAT for the pixel PX by adding the calculated overdriving value for the pixel PX to a gray level represented by the input image data IDAT for the pixel PX. This interpolation between positions may be performed before or after the interpolation between gray levels described above.

As described above, the output image data ODAT may be generated by compensating the input image data IDAT based on the overdriving data stored in the overdriving data memory 160, the data driver 130 may drive the display panel 110 based on the output image data ODAT, and thus the plurality of pixels PX of the display panel 110 may have a substantially uniform charging rate in the display device 100 according to some embodiments of the present disclosure.

The overdriving data stored in the overdriving data memory 160 of the display device 100 may be accurately obtained such that the plurality of pixels PX may have the substantially uniform charging rate. In the display device 100 according to some embodiments of the present disclosure, optimal overdriving data for the display device 100 may be obtained as described below with reference to FIGS. 7 through 10, and the optimal overdriving data may be stored in the overdriving data memory 160.

For example, a first data voltage corresponding to a current line reference gray level may be provided to at least one pixel PX for at least two horizontal times in a first frame, and first luminance of an image displayed based on the first data voltage may be measured. A gate signal GS applied to a previous row line may be shifted, or may be advanced by one horizontal time such that the first data voltage is not provided to the pixel PX located in the previous row line for the two horizontal times.

In some embodiments, one of the plurality of gate clock signals CKN input to the gate driver 120 may be shifted such that the gate signal GS applied to the previous row line may be shifted. To perform this operation, the controller 140 may include a gate clock shifter 150 that shifts at least one of the plurality of gate clock signals CKN input to the gate driver 120 in response to the source emphasis test enable signal STEST_EN. In some embodiments, the gate clock shifter 150 may advance at least one of the plurality of gate clock signals CKN by one horizontal time while the source emphasis test enable signal STEST_EN has an active level. In a second frame, a second data voltage corresponding to a previous line reference gray level may be applied to a data line connected to the at least one pixel PX, a third data voltage where an overdriving voltage corresponding to a predicted overdriving gray level is added to the first data voltage may be provided to the at least one pixel PX for one horizontal time, and second luminance of an image displayed based on the third data voltage may be measured.

The overdriving value for the at least one pixel PX may be determined as the predicted overdriving gray level when the second luminance is substantially the same as the first luminance. The overdriving value may be obtained corresponding to one or more reference gray level pairs at one or more sampling points, and the overdriving data representing the overdriving values may be stored in the overdriving data memory 160. As described above, target luminance (or the first luminance) may be measured after the first data voltage corresponding to the current line reference gray level is provided to the pixel PX for a sufficient time (e.g., for the at least two horizontal times), the overdriving value for the pixel PX may be determined such that luminance of the pixel PX reaches the target luminance, and thus the optimal driving data for the display device 100 may be obtained.

Figure 7:
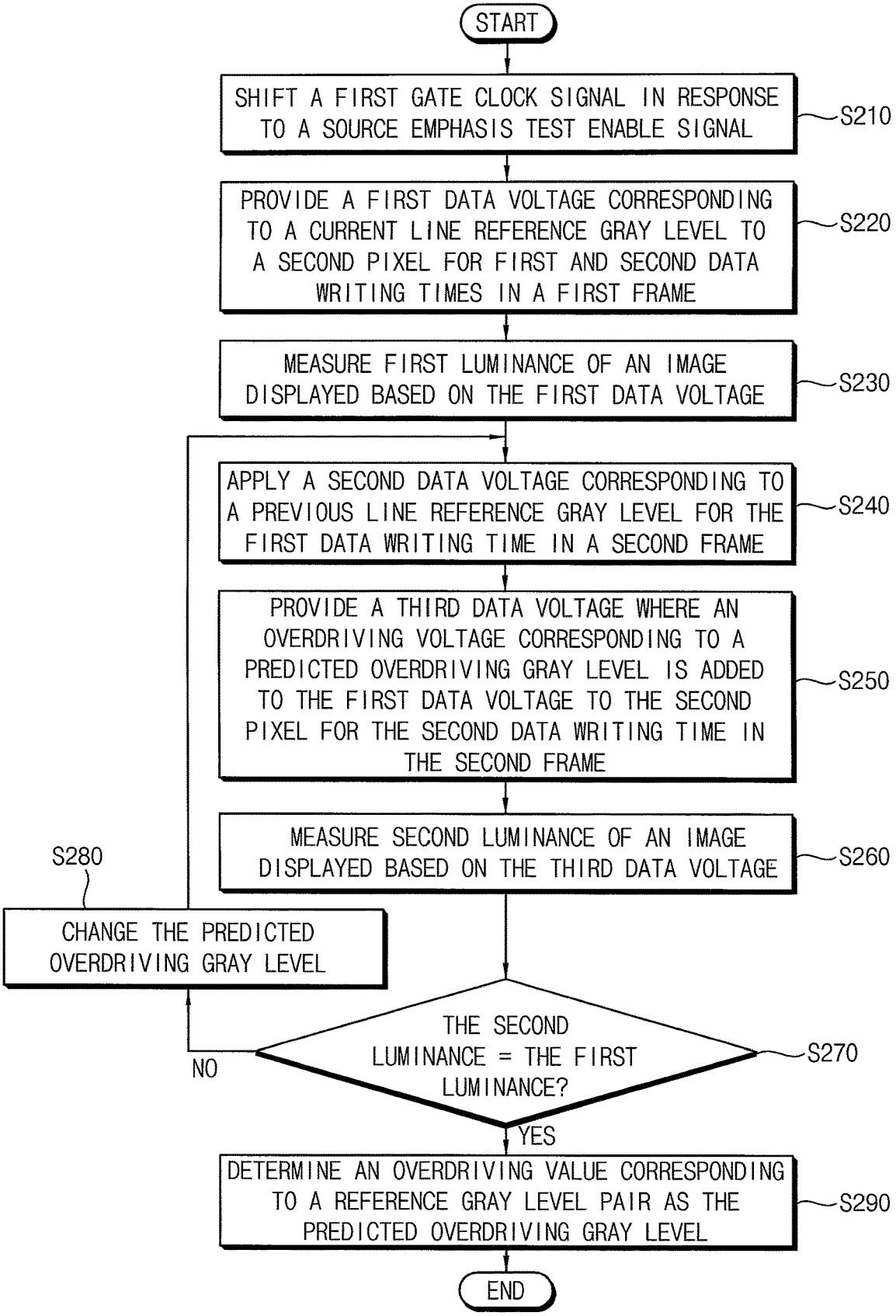
FIG. 7 is a flowchart illustrating a method of obtaining overdriving data of a display device according to some embodiments of the present disclosure.
Figure 8:
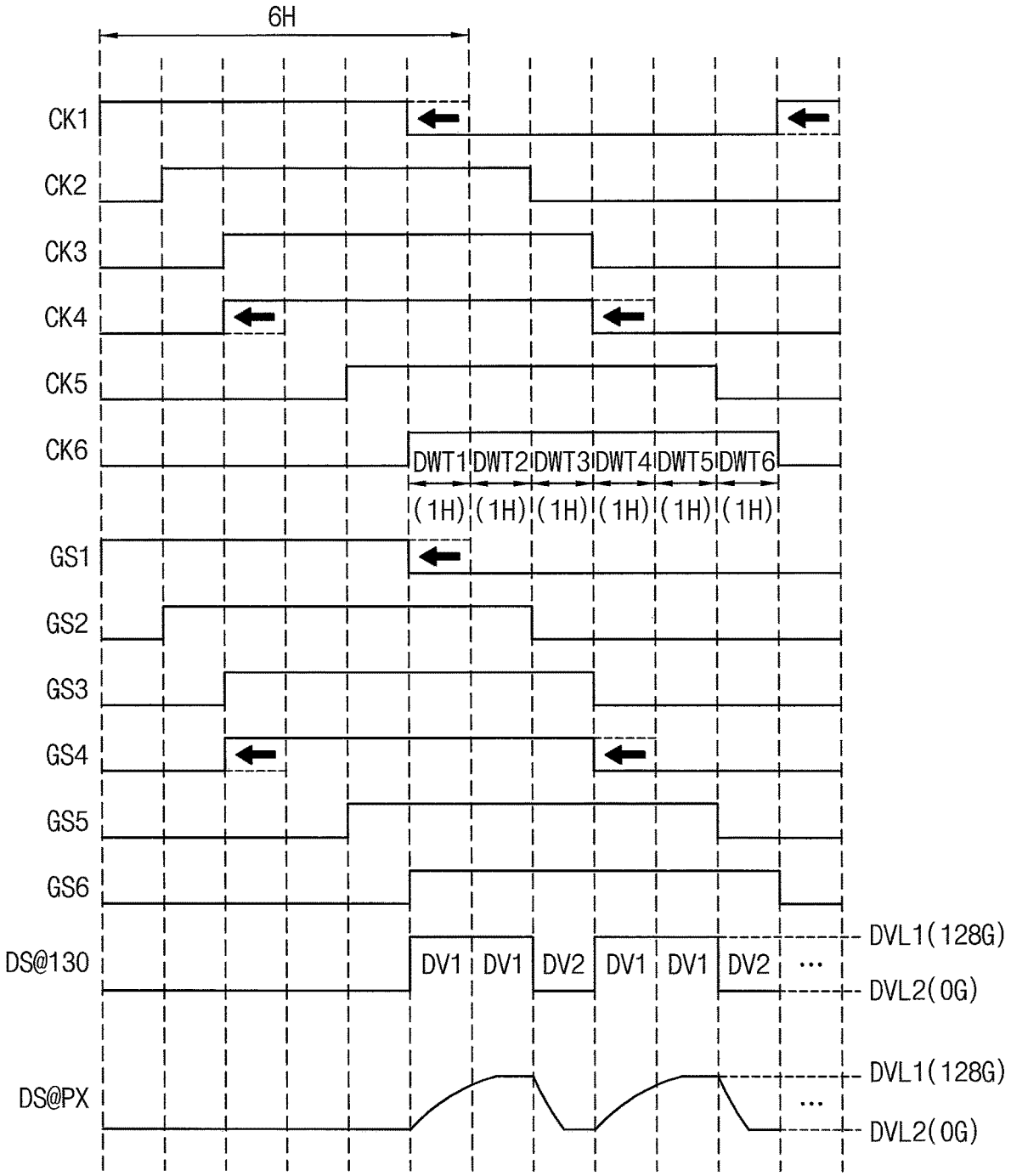
FIG. 8 is a timing diagram illustrating examples of gate clock signals, gate signals, and a data signal of a display device in a first frame.
Figure 9:
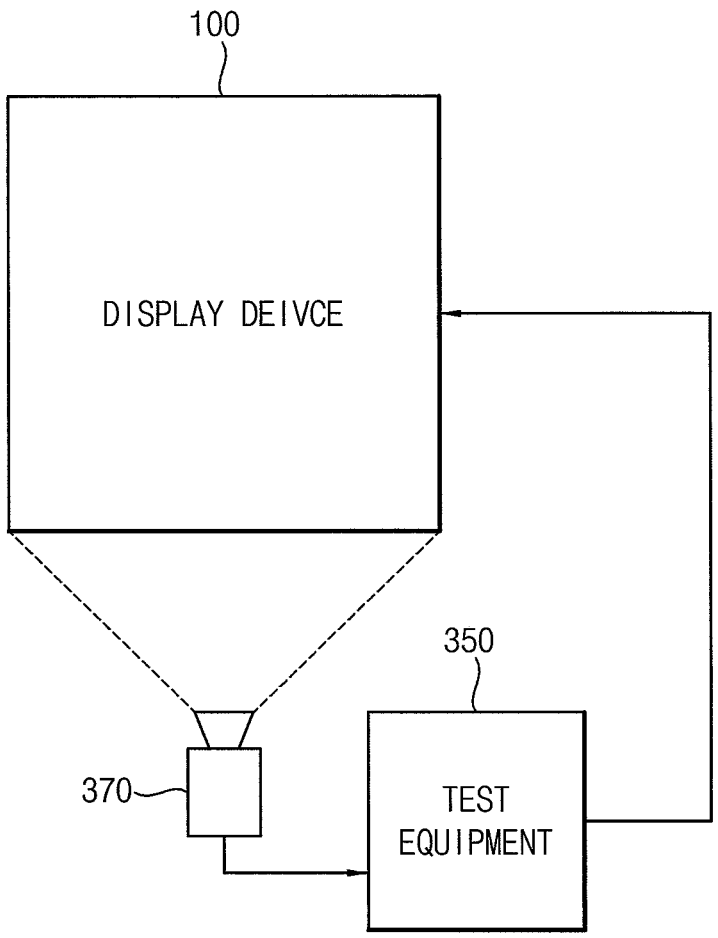
FIG. 9 is a block diagram for describing an example where luminance of an image displayed by a display device.
Figure 10:
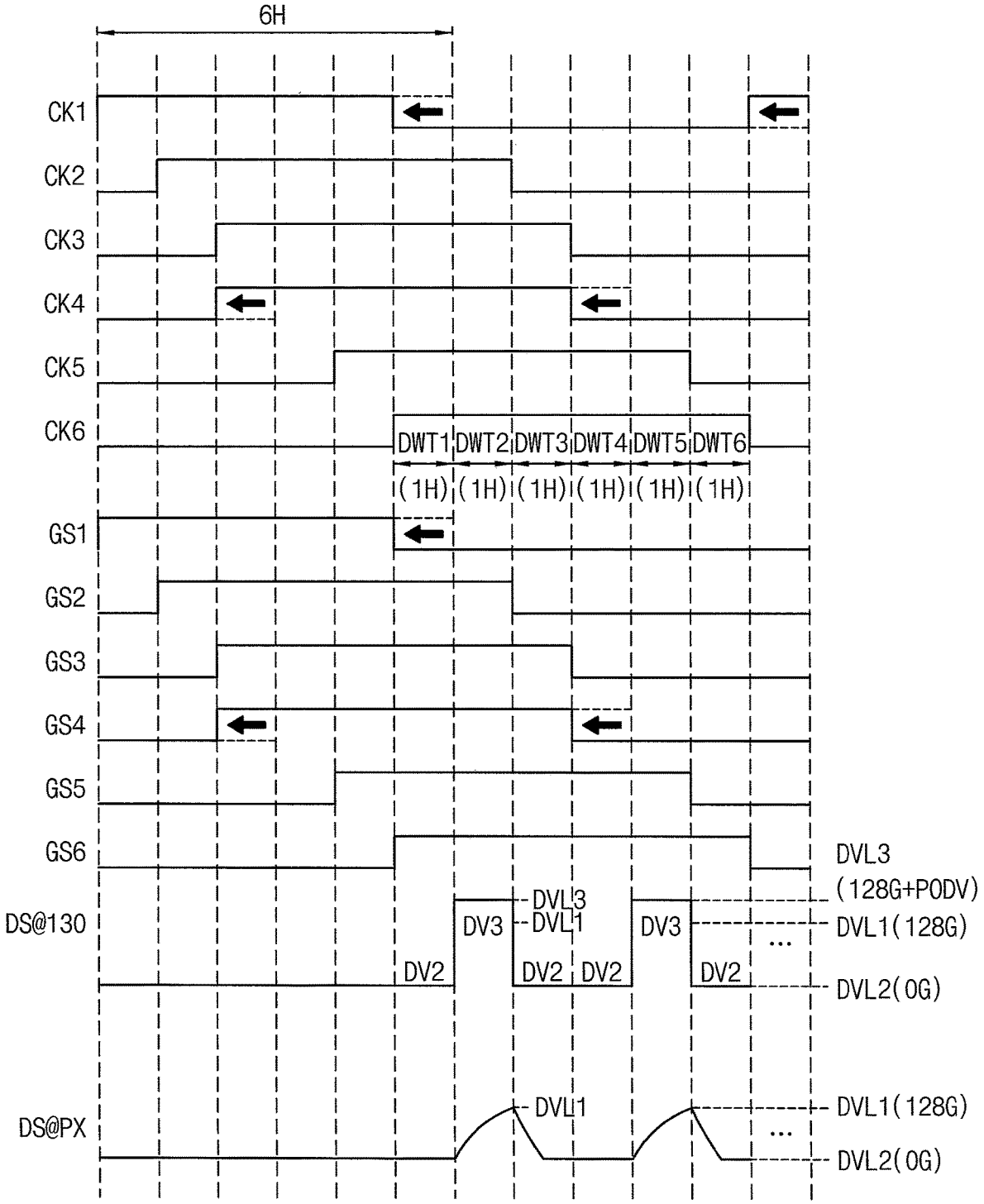
FIG. 10 is a timing diagram illustrating examples of gate clock signals, gate signals, and a data signal of a display device in a second frame.

FIG. 7 is a flowchart illustrating a method of obtaining overdriving data of a display device according to some embodiments of the present disclosure, FIG. 8 is a timing diagram illustrating examples of gate clock signals, gate signals, and a data signal of a display device in a first frame, FIG. 9 is a block diagram for describing an example where luminance of an image displayed by a display device, and FIG. 10 is a timing diagram illustrating examples of gate clock signals, gate signals, and a data signal of a display device in a second frame.

Referring to FIGS. 1, 2, and 7, in a method of obtaining overdriving data of a display device 100 according to some embodiments of the present disclosure, the display device 100 may shift at least one of a plurality of gate clock signals CKN input to a gate driver 120 in response to a source emphasis test enable signal STEST_EN (S210). In some embodiments, the source emphasis test enable signal STEST_EN may have an active level while the method of obtaining the overdriving data is performed, and may have an inactive level after the overdriving data are stored in the overdriving data memory 160. A gate clock shifter 150 may advance at least one of the plurality of gate clock signals CKN while the source emphasis test enable signal STEST_EN has the active level. For example, as illustrated in FIGS. 8 and 10, first through sixth gate clock signals CK1, CK2, CK3, CK4, CK5, and CK6 may be input to the gate driver 120, and the gate clock shifter 150 may advance the first and fourth gate clock signals CK1 and CK4 by one horizontal time.

With respect to first, second, and third pixels BPX, GPX, and RPX respectively connected to first, second, and third gate lines GL1, GL2, and GL3 and connected to the same data line DL, the display device 100 may provide a first data voltage corresponding to a current line reference gray level to the second pixel GPX for a first data writing time for the first pixel BPX and for a second data writing time for the second pixel GPX in a first frame (S220). Further, the display device 100 may provide a second data voltage corresponding to a previous line reference gray level to the third pixel RPX for a third data writing time for the third pixel RPX in the first frame. Here, the first data writing time for the first pixel BPX may be a time allocated for providing and storing a data signal DS in the first pixel BPX, the second data writing time for the second pixel GPX may be a time allocated for providing and storing the data signal DS in the second pixel GPX, and the third data writing time for the third pixel RPX may be a time allocated for providing and storing the data signal DS in the third pixel RPX. Each of the first through third data writing times may have a length of one horizontal time. Further, the second data writing time may start when the first data writing time ends, and the third data writing time may start when the second data writing time ends.

In some embodiments, to provide the first data voltage to the second pixel GPX in the first frame, the display device 100 may shift a first gate signal in the first frame such that the first gate signal is not applied to the first gate line GL1 for the first data writing time in the first frame, may apply a second gate signal to the second gate line GL2 for the first data writing time and for the second data writing time in the first frame, and may apply the first data voltage to the data line DL for the first data writing time and for the second data writing time in the first frame. Further, in some embodiments, the first gate signal (e.g., GS1) may be generated in synchronization with a first gate clock signal (e.g., CK1) that is input to the gate driver 120, and the first gate clock signal input to the gate driver 120 may be shifted to shift the first gate signal.

For example, as illustrated in FIG. 8, first through sixth gate clock signals CK1, CK2, CK3, CK4, CK5, and CK6 each having a high period corresponding to six horizontal times may be input to the gate driver 120. Further, the first and fourth gate clock signals CK1 and CK4 may be shifted by one horizontal time. Thus, the first gate clock signal CK1 may have a phase substantially the same as a phase of an inversion signal of the sixth gate clock signal CK6, and the fourth gate clock signal CK4 may have a phase substantially the same as a phase of the third gate clock signal CK3. Accordingly, first and fourth gate signals GS1 and GS4 generated in synchronization with the first and fourth gate clock signals CK1 and CK4 may be shifted by one horizontal time.

Each frame may sequentially have a plurality of data writing times DWT1, DWT2, DWT3, DWT4, DWT5, and DWT6 respectively corresponding to a plurality of row lines. Each of the plurality of data writing times DWT1, DWT2, DWT3, DWT4, DWT5, and DWT6 may have a length of one horizontal time (1H). In a case where the first through sixth gate clock signals CK1, CK2, CK3, CK4, CK5, and CK6 are not shifted, during each data writing time DWT1, DWT2, DWT3, DWT4, DWT5, and DWT6, a corresponding gate signal GS1, GS2, GS3, GS4, GS5, and GS6 may have a high level, and the corresponding gate signal GS1, GS2, GS3, GS4, GS5, and GS6 may transition to a low level when each data writing time DWT1, DWT2, DWT3, DWT4, DWT5, and DWT6 ends. However, because the first and fourth gate signals GS1 and GS4 are shifted by one horizontal time, the first gate signal GS1 may not be applied to the first gate line GL1 during the first data writing time DWT1 for the first pixel BPX connected to the first gate line GL1, and the fourth gate signal GS4 may not be applied to the fourth gate line GL4 during the fourth data writing time DWT4 for the fourth pixel BPX connected to the fourth gate line GL4.

During the first data writing time DWT1 in the first frame, a data driver 130 may apply the first data voltage DV1 corresponding to the current line reference gray level to the data line DL. Thus, the first data voltage DV1 may be provided to the second pixel GPX connected to the second gate line GL2. For example, the current line reference gray level may be a 128-gray level 128G, and the first data voltage DV1 may have a first data voltage level DVL1 corresponding to the 128-gray level 128G. Because the first gate signal GS1 is not applied to the first gate line GL1 during the first data writing time DWT1, the first data voltage DV1 may not be provided to the first pixel BPX connected to the first gate line GL1.

During the second data writing time DWT2 in the first frame, the data driver 130 may apply the first data voltage DV1 to the data line DL. Thus, the first data voltage DV1 may be provided to the second pixel GPX connected to the second gate line GL2. Even if the second pixel GPX is located relatively far from the data driver 130, the first data voltage DV1 may be provided to the second pixel GPX for the first and second data writing times DWT1 and DWT2, or for two horizontal times, and thus the first data voltage DV1 having a desired voltage level, or the first data voltage level DVL1 corresponding to the 128-gray level 128G, may be provided to the second pixel GPX.

During the third data writing time DWT3 in the first frame, the data driver 130 may apply the second data voltage DV2 corresponding to the previous line reference gray level to the data line DL. Thus, the second data voltage DV2 may be provided to the third pixel RPX connected to the third gate line GL3. For example, the previous line reference gray level may be a 0-gray level OG, and the second data voltage DV2 may have a second data voltage level DVL2 corresponding to the 0-gray level OG.

During the fourth and fifth data writing times DWT4 and DWT5 in the first frame, the data driver 130 may apply the first data voltage DV1 to the data line DL. The first data voltage DV1 may not be provided to the fourth pixel BPX connected to the fourth gate line GL4, and may be provided to the fifth pixel GPX connected to the fifth gate line GL5. Further, during the sixth data writing time DWT6 in the first frame, the data driver 130 may apply the second data voltage DV2 to the data line DL, and thus the second data voltage DV2 may be provided to the sixth pixel RPX connected to the sixth gate line GL6. Even if the fifth pixel GPX is located relatively far from the data driver 130, the first data voltage DV1 having the desired voltage level may be provided to the fifth pixel GPX.

First luminance of an image displayed based on the first data voltage may be measured (S230). In some embodiments, as illustrated in FIG. 9, the first luminance may be measured by a test equipment 350. For example, the test equipment 350 may measure the first luminance by providing test image data (e.g., image data representing the current line reference gray level and the previous line reference gray level) to the display device 100, and by capturing an image displayed by the display device 100 based on the test image data by using a camera 370 (e.g., a charge coupled device (CCD) camera). Because the first data voltage DV1 is not provided to the first pixel BPX and is provided to the second pixel GPX for the first and second data writing times DWT1 and DWT2, or for two horizontal times, the first luminance of the image displayed based on the first data voltage DV1 may be target luminance having a desired luminance level.

The display device 100 may apply the second data voltage corresponding to the previous line reference gray level to the data line DL for the first data writing time in a second frame (S240). In some embodiments, the display device 100 may shift the first gate signal in the second frame such that the first gate signal is not applied to the first gate line GL1 for the first data writing time in the second frame. Further, the display device 100 may provide a third data voltage where an overdriving voltage corresponding to a predicted overdriving gray level is added to the first data voltage to the second pixel GPX for the second data writing time in the second frame (S250). Further, the display device 100 may provide the second data voltage to the third pixel RPX for the third data writing time for the third pixel RPX in the second frame.

For example, as illustrated in FIG. 10, in the second frame, the first and fourth gate clock signals CK1 and CK4 may be shifted by one horizontal time, and thus the first and fourth gate signals GS1 and GS4 generated in synchronization with the first and fourth gate clock signals CK1 and CK4 may be shifted by one horizontal time.

The data driver 130 may apply the second data voltage DV2 corresponding to the previous line reference gray level (e.g., the 0-gray level OG) to the data line DL during the first data writing time DWT1 in the second frame, and may apply the third data voltage DV3 where the overdriving voltage corresponding to the predicted overdriving gray level PODV is added to the first data voltage DV1 corresponding to the current line reference gray level (e.g., the 128-gray level 128G) to the data line DL during the second data writing time DWT2 in the second frame. For example, the third data voltage DV3 may have a third data voltage level DVL3 where a voltage level corresponding to the predicted overdriving gray level PODV is added to the first data voltage level DVL1 of the first data voltage DV1.

In a case where the predicted overdriving gray level PODV is an optimal overdriving gray level, the data signal DS at the second pixel GPX connected to the second gate line GL2, or the third data voltage DV3 at the second pixel GPX, may have the desired voltage level of the first data voltage DV1, or may have the first data voltage level DVL1 corresponding to the 128-gray level, at an end point of the second data writing time DWT2. During the third data writing time DWT3 in the second frame, the data driver 130 may apply the second data voltage DV2 to the data line DL.

The data driver 130 may apply the second data voltage DV2 to the data line DL during the fourth data writing time DWT4 in the second frame, may apply the third data voltage DV3 to the data line DL during the fifth data writing time DWT5 in the second frame, and may apply the second data voltage DV2 to the data line DL during the sixth data writing time DWT6 in the second frame. In a case where the predicted overdriving gray level PODV is an optimal overdriving gray level, the data signal DS at the fifth pixel GPX connected to the fifth gate line GL5 may have the desired voltage level of the first data voltage DV1, or may have the first data voltage level DVL1 corresponding to the 128-gray level, at an end point of the fifth data writing time DWT5.

Second luminance of an image displayed based on the third data voltage may be measured (S260). When the second luminance is different from the first luminance (S270: NO), the predicted overdriving gray level may be changed (S280), the second and third data voltages may again be applied, and the second luminance in the second frame may again be measured (S240, S250, and S260).

When the second luminance is substantially the same as the first luminance (S270: YES), the predicted overdriving gray level may be determined as an overdriving value corresponding to a reference gray level pair of the current line reference gray level and the previous line reference gray level (S290). As described above, because the first luminance may be measured as target luminance after the first data voltage corresponding to the current line reference gray level is provided to each pixel GPX for a sufficient or suitable time (e.g., for two horizontal times), the overdriving value for the pixel GPX may be determined such that the second luminance of the image displayed based on the third data voltage may be substantially the same as the target luminance, and thus the overdriving value may be the optimal overdriving value for the pixel GPX.

In some embodiments, the overdriving value may be determined at each of N*M reference gray level pairs of N current line reference gray levels and M previous line reference gray levels, where N is an integer greater than 0, and M is an integer greater than 0, and overdriving data representing the overdriving values determined at the N*M reference gray level pairs may be generated.

Further, in some embodiments, the overdriving data may be obtained at each of a plurality of sampling positions of a display panel 110, and the overdriving data obtained at the plurality of sampling positions may be stored in a overdriving data memory 160 of the display device 100. As described above, because the overdriving data are generated based on the target luminance measured at the display device 100, the overdriving data may be optimal overdriving data for the display device 100.

Figure 11:
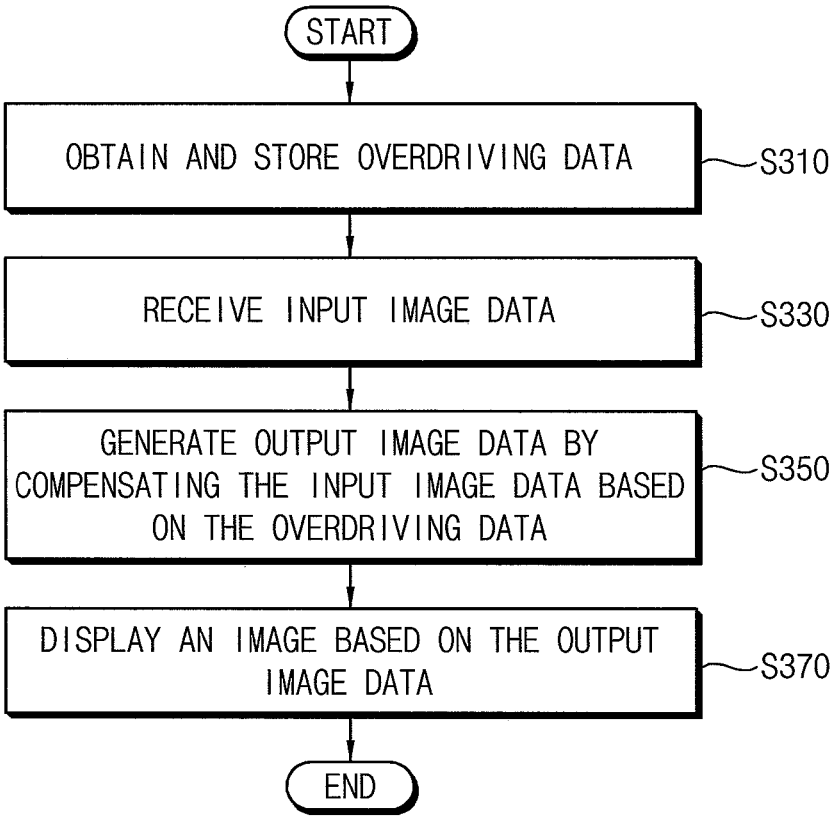
FIG. 11 is a flowchart illustrating a method of operating a display device according to some embodiments of the present disclosure.

FIG. 11 is a flowchart illustrating a method of operating a display device according to some embodiments of the present disclosure.

Referring to FIGS. 1 and 11, in a method of operating a display device 100, overdriving data may be obtained, and the obtained overdriving data may be stored in an overdriving data memory 160 (S310). Obtaining and storing the overdriving data may be performed by the method of FIG. 7.

For example, with respect to first, second, and third pixels respectively connected to first, second, and third gate lines, and also connected to the same data line, a first data voltage corresponding to a current line reference gray level may be provided to the second pixel for a first data writing time for the first pixel and for a second data writing time for the second pixel in a first frame, first luminance of an image displayed based on the first data voltage may be measured, a second data voltage corresponding to a previous line reference gray level may be applied to the data line for the first data writing time in a second frame, a third data voltage (where an overdriving voltage corresponding to a predicted overdriving gray level is added to the first data voltage) may be provided to the second pixel for the second data writing time in the second frame, second luminance of an image displayed based on the third data voltage may be measured, an overdriving value corresponding to a reference gray level pair of the current line reference gray level and the previous line reference gray level may be determined as the predicted overdriving gray level when the second luminance is substantially the same as the first luminance, and overdriving data representing the determined overdriving value may be stored in the overdriving data memory 160 of the display device 100.

The display device 100 may receive input image data IDAT (S330), may generate output image data ODAT by compensating the input image data IDAT based on the overdriving data stored in the overdriving data memory 160 (S350), and may display an image based on the output image data ODAT (S370).

In some embodiments, the overdriving value may be determined at each of N*M reference gray level pairs of N current line reference gray levels and M previous line reference gray levels, where N is an integer greater than 0, and M is an integer greater than 0, and the overdriving data stored in the overdriving data memory 160 may represent the overdriving values determined at the N*M reference gray level pairs.

In a case where the input image data IDAT represent a first gray level with respect to the first pixel, and represent a second gray level with respect to the second pixel, the overdriving value for the second pixel may be calculated by performing a bilinear interpolation on the overdriving values at the reference gray level pairs of two previous line reference gray levels adjacent to the first gray level among the M previous line reference gray levels and two current line reference gray levels adjacent to the second gray level among the N current line reference gray levels, and the output image data ODAT for the second pixel may be generated by adding the overdriving value for the second pixel to the second gray level.

Further, in some embodiments, the overdriving data may be obtained at each of a plurality of sampling positions of a display panel 110 of the display device 100, and the overdriving data obtained at the plurality of sampling positions may be stored in the overdriving data memory 160. The overdriving value for each pixel PX may be calculated by performing a bilinear interpolation on the overdriving values at four sampling positions adjacent to the pixel PX among the plurality of sampling positions, and the output image data ODAT for the pixel PX may be generated by adding the calculated overdriving value for the pixel PX to a gray level represented by the input image data IDAT for the pixel PX.

As described above, because the output image data ODAT are generated by compensating the input image data IDAT based on the overdriving data stored in the overdriving data memory 160, and because the image is displayed based on the output image data ODAT, the plurality of pixels PX of the display panel 110 may have a substantially uniform charging rate in the display device 100 according to some embodiments of the present disclosure, and thus the display quality of the display device 100 may be improved.

Figure 12:
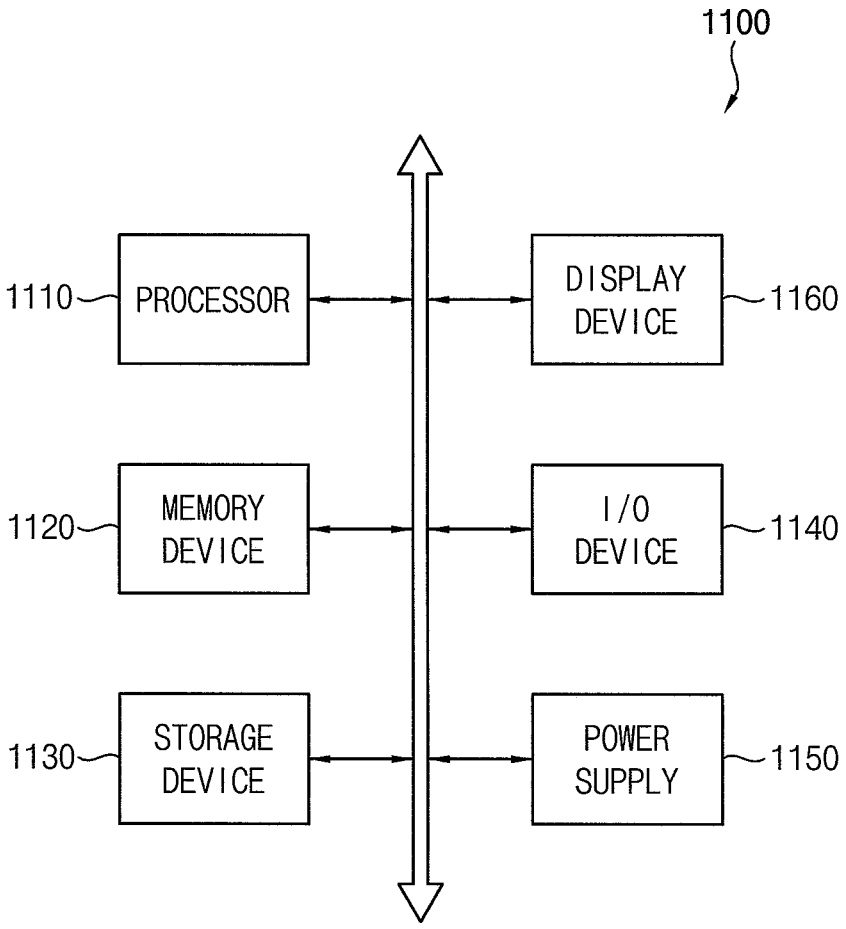
FIG. 12 is a block diagram illustrating an example of an electronic device including a display device according to some embodiments of the present disclosure.

FIG. 12 is a block diagram illustrating an example of an electronic device including a display device according to some embodiments of the present disclosure.

Referring to FIG. 12, an electronic device 1100 may include a processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a microprocessor, a central processing unit (CPU), etc. The processor 1110 may be coupled to other components via an address bus, a control bus, a data bus, etc. Further, in some embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc., and an output device such as a printer, a speaker, etc. The power supply 1150 may supply power for operations of the electronic device 1100.

In the display device 1160, first luminance may be measured by providing a data voltage corresponding to a current line reference gray level to at least one pixel for at least two horizontal times in a first frame, second luminance may be measured by providing a voltage where an overdriving voltage corresponding to a predicted overdriving gray level is added to the data voltage to the at least one pixel for one horizontal time in a second frame, and an overdriving value for the at least one pixel may be determined based on the first luminance and the second luminance. Accordingly, optimal overdriving data for the display device 1160 may be obtained.

According to some embodiments, the electronic device 1100 may be any electronic device including the display device 1160, such as a digital television, a 3D television, a personal computer (PC), a home appliance, a laptop computer, a cellular phone, a smart phone, a tablet computer, a wearable device, a personal digital assistant (PDA), a portable multimedia player (PMP), a digital camera, a music player, a portable game console, a navigation system, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims, with functional equivalents thereof to be included therein.

What is claimed is:

1. A method of obtaining overdriving data of a display device, the display device comprising first, second, and third pixels respectively connected to first, second, and third gate lines and connected to a same data line, the method comprising:

providing a first data voltage corresponding to a current line reference gray level to the second pixel for a first data writing time for the first pixel and for a second data writing time for the second pixel in a first frame;

measuring first luminance of an image displayed based on the first data voltage;

applying a second data voltage corresponding to a previous line reference gray level to the data line for the first data writing time in a second frame;

providing a third data voltage, which comprises an overdriving voltage corresponding to a predicted overdriving gray level added to the first data voltage, to the second pixel for the second data writing time in the second frame;

measuring second luminance of an image displayed based on the third data voltage; and determining an overdriving value corresponding to a reference gray level pair of the current line reference gray level and the previous line reference gray level as the predicted overdriving gray level when the second luminance is same as the first luminance.

2. The method of claim 1, wherein providing the first data voltage to the second pixel in the first frame comprises:

shifting a first gate signal in the first frame such that the first gate signal is not applied to the first gate line for the first data writing time in the first frame;

applying a second gate signal to the second gate line for the first data writing time and the second data writing time in the first frame; and applying the first data voltage to the data line for the first data writing time and the second data writing time in the first frame.

3. The method of claim 2, further comprising generating the first gate signal in synchronization with a first gate clock signal input to a gate driver, wherein shifting the first gate signal comprises shifting the first gate clock signal input to the gate driver.

4. The method of claim 3, further comprising advancing the first gate clock signal by one horizontal time while a source emphasis test enable signal has an active level.

5. The method of claim 1, further comprising providing the second data voltage to the third pixel for a third data writing time for the third pixel in the first frame.

6. The method of claim 1, further comprising shifting a first gate signal in the second frame such that the first gate signal is not applied to the first gate line for the first data writing time in the second frame.

7. The method of claim 1, further comprising changing the predicted overdriving gray level when the second luminance is different from the first luminance.

8. The method of claim 1, further comprising providing the second data voltage to the third pixel for a third data writing time for the third pixel in the second frame.

9. The method of claim 1, further comprising displaying different respective colors by the first, second, and third pixels.

10. The method of claim 9, wherein the first pixel comprises a blue pixel, the second pixel comprises a green pixel, and the third pixel comprises a red pixel.

11. The method of claim 1, further comprising:

determining the overdriving value at each of N*M reference gray level pairs of N current line reference gray levels and M previous line reference gray levels, N being an integer greater than 0, and M being an integer greater than 0; and storing the overdriving data representing the overdriving values determined at the N*M reference gray level pairs in an overdriving data memory of the display device.

12. The method of claim 11, further comprising obtaining the overdriving data at each of a plurality of sampling positions of a display panel of the display device; and storing the overdriving data obtained at the plurality of sampling positions in the overdriving data memory.

13. A method of operating a display device, the display device comprising first, second, and third pixels respectively connected to first, second, and third gate lines and connected to a same data line, the method comprising:

providing a first data voltage corresponding to a current line reference gray level to the second pixel for a first data writing time for the first pixel and a second data writing time for the second pixel in a first frame;

measuring first luminance of an image displayed based on the first data voltage;

applying a second data voltage corresponding to a previous line reference gray level to the data line for the first data writing time in a second frame;

providing a third data voltage, which comprises an overdriving voltage corresponding to a predicted overdriving gray level added to the first data voltage, to the second pixel for the second data writing time in the second frame;

measuring second luminance of an image displayed based on the third data voltage;

determining an overdriving value corresponding to a reference gray level pair of the current line reference gray level and the previous line reference gray level as the predicted overdriving gray level when the second luminance is same as the first luminance;

storing overdriving data representing the determined overdriving value in an overdriving data memory of the display device;

receiving input image data;

generating output image data by compensating the input image data based on the overdriving data; and displaying an image based on the output image data.

14. The method of claim 13, further comprising determining the overdriving value at each of N*M reference gray level pairs of N current line reference gray levels and M previous line reference gray levels, where N is an integer greater than 0, and M is an integer greater than 0, wherein the overdriving data stored in the overdriving data memory represent the overdriving values determined at the N*M reference gray level pairs.

15. The method of claim 14, wherein, when the input image data represent a first gray level with respect to the first pixel, and represent a second gray level with respect to the second pixel, the method further comprises:

calculating the overdriving value for the second pixel by performing a bilinear interpolation on the overdriving values at the reference gray level pairs of two previous line reference gray levels adjacent to the first gray level among the M previous line reference gray levels and two current line reference gray levels adjacent to the second gray level among the N current line reference gray levels; and generating the output image data for the second pixel by adding the overdriving value for the second pixel to the second gray level.

16. The method of claim 13, further comprising:

obtaining the overdriving data at each of a plurality of sampling positions of a display panel of the display device; and storing the overdriving data obtained at the plurality of sampling positions in the overdriving data memory.

17. The method of claim 16, further comprising:

calculating the overdriving value for each pixel by performing a bilinear interpolation on the overdriving values at four sampling positions adjacent to each pixel among the plurality of sampling positions; and generating the output image data for each pixel by adding the calculated overdriving value for each pixel to a gray level represented by the input image data for each pixel.

18. A display device comprising:

a display panel comprising a plurality of pixels;

a gate driver configured to provide gate signals to the plurality of pixels;

a data driver configured to provide data signals to the plurality of pixels;

an overdriving data memory configured to store overdriving data representing an overdriving value for at least one pixel among the plurality of pixels; and a controller configured to control the gate driver and the data driver, wherein the data driver is configured to:

provide a first data voltage corresponding to a current line reference gray level to the at least one pixel for at least two horizontal times in a first frame, wherein first luminance of an image displayed based on the first data voltage is measured; and apply a second data voltage corresponding to a previous line reference gray level to a data line connected to the at least one pixel in a second frame, and provide a third data voltage, which comprises an overdriving voltage corresponding to a predicted overdriving gray level added to the first data voltage, to the at least one pixel for one horizontal time in the second frame, wherein second luminance of an image displayed based on the third data voltage is measured, and wherein the overdriving value for the at least one pixel is determined as the predicted overdriving gray level when the second luminance is same as the first luminance.

19. The display device of claim 18, wherein the controller comprises a gate clock shifter configured to shift at least one of a plurality of gate clock signals input to the gate driver in response to a source emphasis test enable signal.

20. The display device of claim 18, wherein the controller comprises a data compensator configured to receive input image data, to generate output image data by compensating the input image data based on the overdriving data stored in the overdriving data memory, and to provide the output image data to the data driver.

* * * * *